US011603790B2

(12) United States Patent
Usuki

(10) Patent No.: US 11,603,790 B2
(45) Date of Patent: Mar. 14, 2023

(54) HEAT EXCHANGER

(71) Applicant: DENSO CORPORATION, Kariya (JP)

(72) Inventor: Fumihiko Usuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 129 days.

(21) Appl. No.: 16/836,298

(22) Filed: Mar. 31, 2020

(65) Prior Publication Data

US 2020/0224580 A1 Jul. 16, 2020

Related U.S. Application Data

(63) Continuation of application No. PCT/JP2018/033581, filed on Sep. 11, 2018.

(30) Foreign Application Priority Data

Oct. 20, 2017 (JP) ..... JP2017-203360

(51) Int. Cl.

| | |
|---|---|
| ***F01P 3/12*** | (2006.01) |
| ***F01P 3/18*** | (2006.01) |
| ***F28D 1/053*** | (2006.01) |
| ***F28F 9/02*** | (2006.01) |
| *F28D 21/00* | (2006.01) |
| *F28F 9/26* | (2006.01) |

(52) U.S. Cl.

CPC ..... *F01P 3/12* (2013.01); *F01P 3/18* (2013.01); *F28D 1/05366* (2013.01); *F28F 9/0246* (2013.01); *F28D 2021/0091* (2013.01); *F28F 9/0204* (2013.01); *F28F 9/26* (2013.01); *F28F 2009/0287* (2013.01)

(58) Field of Classification Search

CPC ..... F28F 9/0246; F28F 9/0204; F28F 9/26; F28F 2009/0287; F01P 3/12; F01P 3/18; F28D 1/05366

USPC ..... 165/173

See application file for complete search history.

(56) References Cited

U.S. PATENT DOCUMENTS

2002/0040776 A1* 4/2002 Kokubunji ..... F28F 9/0226 165/135
2008/0216777 A1* 9/2008 Vetrovec ..... F01P 11/20 123/41.29
2010/0126692 A1* 5/2010 Min ..... F28D 1/0417 165/41

(Continued)

FOREIGN PATENT DOCUMENTS

JP 2017106668 A 6/2017

*Primary Examiner* — Joel M Attey
(74) *Attorney, Agent, or Firm* — Harness, Dickey & Pierce, P.L.C.

(57) ABSTRACT

A heat exchanger includes a core and a header tank. The header tank includes a partition, a first inlet pipe, and a second inlet pipe. The partition divides an inside passage of the header tank into a first tank and a second tank. The first inlet pipe introduces a first fluid into the first tank. The second inlet pipe introduces a second fluid into the second tank. The first inlet pipe is inclined at a predetermined angle except a right angle relative to an outer surface of the header tank such that a flow direction of the first fluid flowing from the first inlet pipe to the first tank includes a component in a predetermined direction from a first end of the first tank provided with the partition to a second end of the first tank opposite to the first end.

11 Claims, 6 Drawing Sheets

(56) References Cited

U.S. PATENT DOCUMENTS

| | | | | |
|---|---|---|---|---|
| 2011/0168372 | A1* | 7/2011 | Takahashi | F28F 9/0226 165/173 |
| 2012/0247742 | A1* | 10/2012 | Mizuno | F28D 1/05391 165/173 |
| 2015/0129187 | A1* | 5/2015 | Nagafuji | F28D 1/05375 165/173 |
| 2018/0363987 | A1 | 12/2018 | Itou et al. | |

* cited by examiner

HEAT EXCHANGER

CROSS REFERENCE TO RELATED APPLICATION

The present application is a continuation application of International Patent Application No. PCT/JP2018/033581 filed on Sep. 11, 2018, which designated the U.S. and claims the benefit of priority from Japanese Patent Application No. 2017-203360 filed on Oct. 20, 2017. The entire disclosures of all of the above applications are incorporated herein by reference.

TECHNICAL FIELD

The present disclosure relates to a heat exchanger.

BACKGROUND

A vehicle such as a hybrid vehicle and a plug-in hybrid electric vehicle utilizes two types of driving force that are an internal combustion engine and an electric motor. Such vehicle requires a radiator for cooling the internal combustion engine and another radiator for cooling electric systems such as an inverter. However, arrangement of the two radiators may cause in increase of ventilation resistance and deterioration in heat radiation property due to increase in temperature of cooling air. To overcome these issues, a heat exchanger including two cooling circuits has been known.

SUMMARY

According to an aspect of the present disclosure, a heat exchanger includes a core in which multiple tubes are stacked, and a header tank located at an end of the multiple tubes in a longitudinal direction of the tubes and in communication with the multiple tubes. The header tank includes a partition, a first inlet pipe, and a second inlet pipe. The partition divides an inside passage of the header tank into a first tank and a second tank. The first inlet pipe introduces a first fluid into the first tank, and the second inlet pipe introduces a second fluid into the second tank. The second fluid has a temperature range different from the first fluid. The first tank has a first end at which the partition is provided and a second end that is opposite to the first end. The first inlet pipe is inclined at a predetermined angle except a right angle relative to an outer surface of the header tank such that a flow direction of the first fluid includes a component in a predetermined direction that is a direction from the first end to the second end.

DETAILED DESCRIPTION

Figure 1:
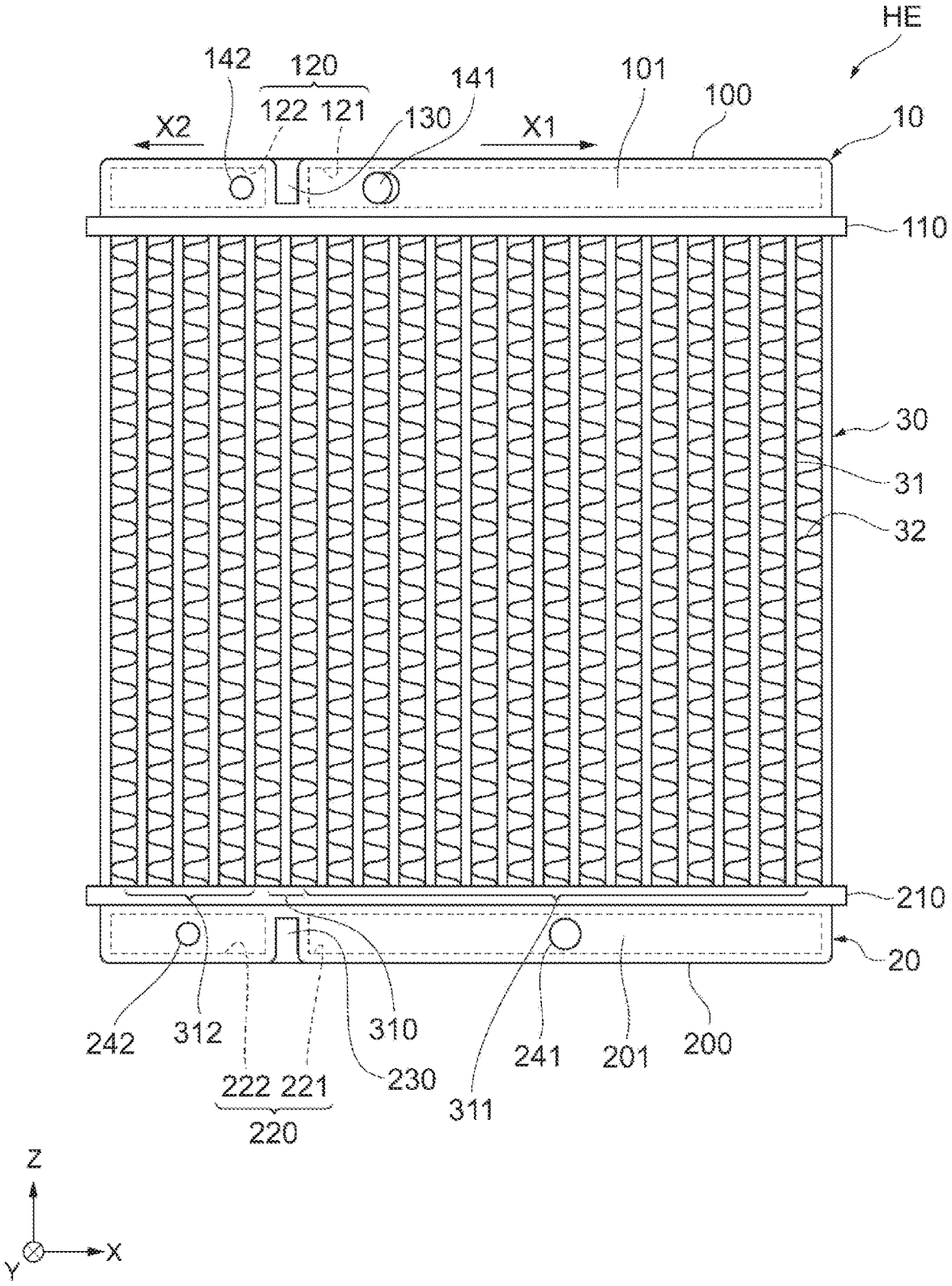
FIG. 1 is a front view of a heat exchanger according to a first embodiment.

To begin with, examples of relevant techniques will be described.

A vehicle such as a hybrid vehicle and a plug-in hybrid electric vehicle utilizes two types of driving force that are an internal combustion engine and an electric motor. Such vehicle requires a radiator for cooling the internal combustion engine and another radiator for cooling electric systems such as an inverter. However, arrangement of the two radiators may cause in increase of ventilation resistance and deterioration in heat radiation property due to increase in temperature of cooling air. To overcome these issues, a heat exchanger including two cooling circuits has been known.

The heat exchanger includes a core having multiple tubes and a pair of header tanks disposed at both ends of the core. Each of the header tanks includes a partition that divides an inner space of the header tank into a first tank and a second tank. The first tank and tubes of the core connected to the first tank constitute a first cooling circuit through which engine cooling water flows. The second tank and tubes connected to the second tank constitute a second cooling circuit thorough which cooling water for the electric systems flows. The first tank includes a baffle plate to reduce flow rate of the engine cooling water supplied to at least a first tube from the partition wall. The baffle plate reduces the flow rate of the cooling water flowing to a boundary between the first cooling circuit and the second cooling circuit. This limits thermal distortion at the boundary caused by the temperature difference between the two-kinds of cooling water respectively flowing in the first cooling circuit and the second cooling circuit.

When the vehicle travels at extremely low temperature, the temperature of the cooling water for the electric systems is lower than the temperature of the engine cooling water by a large degree. Under such condition, the temperature difference between the two-kinds of cooling water respectively flowing in the first cooling circuit and the second cooling circuit becomes larger. Thus, the baffle plate in the first tank may not sufficiently restrict the thermal distortion of the core.

The present disclosure provides a heat exchanger in which two kinds of fluids having different temperatures flow and that is configured to restrict thermal distortion at a core caused by the temperature difference between the two kinds of fluids more effectively.

According to an exemplar embodiment of the present disclosure, a heat exchanger includes a core in which multiple tubes are stacked, and a header tank located at an end of the multiple tubes in a longitudinal direction of the tubes and in communication with the multiple tubes. The header tank includes a partition, a first inlet pipe, and a second inlet pipe. The partition divides an inside passage of the header tank into a first tank and a second tank. The first inlet pipe introduces a first fluid into the first tank, and the second inlet pipe introduces a second fluid into the second tank. The second fluid has a temperature range different from the first fluid. The first tank has a first end at which the partition is provided and a second end that is opposite to the first end. The first inlet pipe is inclined at a predetermined angle except a right angle relative to an outer surface of the header tank such that a flow direction of the first fluid includes a component in a predetermined direction that is a direction from the first end to the second end.

According to this configuration, the first fluid flowing from the first inlet pipe to the first tank is likely to flow away from the partition of the first tank in the predetermined direction. That is, the first fluid is restricted from flowing toward the partition. A part of the core corresponding to the partition in the longitudinal direction is a boundary between a first cooling circuit of the first fluid and a second cooling circuit of the second fluid. The first fluid has a difficulty in flowing toward the partition, which means the first fluid is less likely to flow into the tubes near the boundary between the cooling circuits of the core. The temperature difference between the first fluid and the second fluid that are flowing through tubes around the boundary rises a temperature gradient. This configuration can restrict the first fluid to flow into the tubes around the border, thus the temperature gradient can be reduced. Therefore, the thermal distortion at the core is restricted more effectively.

According to another exemplar embodiment of the present disclosure, a heat exchanger includes a core in which multiple tubes are stacked, a pair of a first and second header tanks disposed respectively at both ends of the core in a longitudinal direction of the tubes. The pair of the first and second header tanks are in communication with the multiple tubes. The first header tank includes a first partition, a first inlet pipe, and a second inlet pipe. The first partition separates an inner space of the header tank into a first tank and a second tank. The first inlet pipe introduces a first fluid to the first tank, and the second inlet pipe introduces a second fluid having a temperature range different from the first fluid to a second tank. The second header tank includes a second partition, a first outlet pipe, and a second outlet pipe. The second partition divides an inner space of the second header tank into a third tank and a fourth tank. The third tank and the fourth tank are respectively in communication with the first tank and the second tank through the tubes. The first fluid flows out of the third tank through the first outlet pipe, and the second fluid flows out of the fourth tank through the second outlet pipe. The first inlet pipe is located at a position away from the partition by a predetermined distance from the first outlet pipe in a predetermined direction that is a direction from a first end of the first tank at which the partition is provided to a second end of the first tank opposite to the first end.

According to this configuration, the first fluid that flows from the first inlet pipe into the first tank is likely to flow toward the first outlet pipe, thereby restricting the first fluid to flow to the partition in the first tank. A part of the core that corresponds to the partition in the longitudinal direction is a boundary between a first cooling circuit in which the first fluid flows and a second cooling circuit in which the second fluid flows. The first fluid is less likely to flow to the partition, and as a result, the first fluid is restricted to flow into the tubes around the boundary between the first cooling circuit and the second cooling circuit of the core. Accordingly, the temperature gradient at the tubes around the boundary caused by the temperature difference between the first fluid and the second fluid is reduced. Thus, the thermal distortion at the core is limited more effectively.

Hereinafter, embodiments will be described with reference to drawings. In the embodiments, a part that corresponds to a matter described in a preceding embodiment may be assigned with the same reference numeral, and redundant explanation for the part may be omitted for description purposes.

First Embodiment

A heat exchanger HE according to a first embodiment will be described in reference to FIGS. 1, 2A and 2B. The heat exchanger HE is mounted in a vehicle such as a hybrid vehicle, and functions as a radiator for cooling waters of an internal combustion engine and electric systems such as an inverter. In this embodiment, the engine cooling water corresponds to a first fluid and the cooling water for the electric systems corresponds to a second fluid. The temperature of the engine cooling water is normally higher than the temperature of the cooling water for the electric systems. That is, two kinds of cooling water having different temperature ranges flow in the heat exchanger HE.

The heat exchanger HE includes an upper header tank 10, a lower header tank 20, and a core 30. The upper header tank 10 and the lower header tank 20 are respectively located at two ends of the core 30. The core 30 is a heat exchange part in which the cooling water flowing therein exchanges heat with air. The core 30 includes multiple tubes 31 and multiple fins 32.

The multiple tubes 31 has a flat and elongated tube extending in a direction shown by an arrow Z. Each of the tubes 31 defines a passage therein through which the engine cooling water or the cooling water for the electric systems flows. The tubes 31 are disposed with a predetermined interval each other in a direction shown in an arrow X that is perpendicular to the direction of the arrow Z. The fins 32 are disposed between the tubes 31 adjacent each other. The fins 32 are so-called corrugated fins that are formed by corrugating a thin and long metal plate.

In the core 30, air flows spaces between the tubes 31 in a direction perpendicular to the direction of the arrow X and the arrow Z (i.e., a direction shown by an arrow Y). The air passing through the core 30 exchanges heat with the cooling water flowing through the tubes 31 to cool the cooling water in the tubes 31. The fins 32 increase a heat transfer area to improve a heat exchange property of the heat exchanger HE.

In following, the direction shown in the arrow X is referred as a "tube arraignment direction X", the direction shown in the arrow Y is referred as an "airflow direction Y", and the direction shown in the arrow Z is referred as a "tube longitudinal direction". The tube longitudinal direction Z is parallel with a vertical direction, in the example shown in FIG. 1.

The upper header tank 10 is located upper than the lower header tank 20 in the vertical direction. Upper ends of the multiple tubes 31 are fluidly connected to the upper header tank 10. The upper header tank 10 receives the engine cooling water and the cooling water for the electric systems and distributes the tow-kinds of cooling water into multiple tubes 31. The upper header tank 10 includes a body 100 and a core plate 110.

The body 100 has a box shape having an opening at one surface of the body 100. The core plate 110 is joined to the opening of the body 100. Specifically, a piece of the core plate 110 is bent and crimped to a flange of the body 100 to join the core plate 110 and the body 100. Inner surfaces of the body 100 and the core plate 110 define an inside passage 120 of the upper header tank 10. An outer surface 101 is a surface of the body 100 located at a position upstream of the body 100 in the airflow direction Y.

The body 100 includes a partition 130 dividing the inside passage 120 of the upper header tank 10 into a first tank 121 and a second tank 122. In this embodiment, the partition 130 corresponds to a first partition. The first tank 121 and the second tank 122 are tank spaces independent each other, which means that the cooling water flowing in either one of the first tank 121 or the second tank 122 cannot flow into the other tank. The first tank 121 is larger than the second tank 122.

A direction shown in an arrow X1 in figures indicates a direction from a first end of the first tank 121 at which the partition 130 is provided to a second end of the first tank 121 opposite to the first end in the X direction. A direction shown in an arrow X2 in figures indicates a direction from a first end of the second tank 122 at which the partition 130 is provided to a second end of the second tank 122 opposite to the first end of the second tank 122 in the X direction. The arrows X1 and X2 are parallel with the tube arraignment direction X. In this embodiment, the direction shown by the arrow X1 corresponds to a predetermined direction from the first end to the second end of the first tank, and the direction shown by the arrow X2 corresponds to a predetermined direction from the first end to the second end of the second tank.

The upper ends of the tubes 31 are inserted into and joined to the core plate 110. As a result, the first tank 121 and the second tank 122 are severally in communication with inside passages of the tubes 31. In following, some tubes of the multiple tubes 31 fluidly connected to the first tank 121 are refereed as first tubes 311, and some tubes of the multiple tubes 31 fluidly connected to the second tank 122 are refereed as second tubes 312.

The multiple tubes 31 includes one dummy tube 310 or plural dummy tubes 310 located between the first tubes 311 and the second tubes 312. The at least one dummy tube 310 is connected to the upper header tank 10 at the partition 130. In other words, the at least one dummy tube 310 is not fluidly connected to either the first tank 121 or the second tank 122. That is, the two-kinds cooling water cannot flow in the at least one dummy tube 310 while flowing in the first tubes 311 or the second tubes 312.

The body 100 is provided with a first inlet pipe 141 and a second inlet pipe 142 at the outer surface 101 of the body 100.

The first inlet pipe 141 is located at a position of the first tank 121, shifted from the partition 130 by a predetermined distance in the predetermined direction X1. As shown in FIGS. 2A and 2B, a center axis m1 of the first inlet pipe 141 is inclined at an angle except a right angle relative to the outer surface 101 of the body 100. The first inlet pipe 141 extends from the outer surface 101 in the airflow direction Y toward upstream in the airflow direction. The first inlet pipe 141 has a first end 141*a* directly connected to the body 100 and a second end 141*b* opposite to the first end 141*a*, and the first end 141*a* is shifted from the second end 141*b* in the direction shown by the arrow X1. In other words, the first end 141*a* is located further from the partition 130 in the X direction than the second end 141*b* is. The first inlet pipe 141 receives the engine cooling water. The engine cooling water flowing into the first inlet pipe 141 further flows in the first tank 121 and is distributed into the first tubes 311 of the core 30.

The second inlet pipe 142 is located at a position of the second tank 122 of the body 100, shifted from the partition 130 by a predetermined distance in the predetermined direction X2. The second inlet pipe 142 substantially extends parallel with the airflow direction Y toward upstream in the airflow direction Y. The second inlet pipe 142 receives the cooling water for the electric systems. The cooling water for the electric systems flowing into the second inlet pipe 142 further flows in the second tank 122 and is distributed into the second tubes 312 of the core 30.

As shown in FIG. 1, lower ends of the multiple tubes 31 are connected to the lower header tank 20. The lower header tank 20 receives the cooling water flowing through the multiple tubes 31, and releases the two kinds of cooling water merged in the lower header tank 20. The lower header tank 20 includes a body 200 and a core plate 210 similarly to the upper header tank 10. The configuration of the lower header tank 20 is similar to the upper header tank 10, thus the configuration of the lower header tank 20 is explained mainly at different points from the upper header tank 10.

The body 200 of the lower header tank 20 includes a partition 230 that divides an inside passage 220 of the lower header tank 20 into a third tank 221 and a fourth tank 222. In this embodiment, the partition 230 corresponds to a second partition. The partition 230 is located at substantially the same position with the partition 130 of the upper header tank 10 in the tube longitudinal direction Z. The third tank 221 is located at the same position with the first tank 121 of the upper header tank 10 in the tube longitudinal direction Z. The third tank 221 is in communication with the first tank 121 through the first tubes 311. The fourth tank 222 is located at substantially the same position with the second tank 122 in the tube longitudinal direction Z. The fourth tank 222 is in communication with the second tank 122 through the second tubes 312. The at least one dummy tube 310 is not in communication with either the third tank 221 or the fourth tank 222.

The body 200 includes a first outlet pipe 241 and a second outlet pipe 242 at an outer surface 201 of the body 200.

The first outlet pipe 241 is located at a substantially center part of the third tank 221. In the lower header tank 20, the engine cooling water flowing through the first tubes 311 merges in the third tank 221 and flows out of the first outlet pipe 241.

The second outlet pipe 242 is located at a substantially center part of the fourth tank 222. In the lower header tank 20, the cooling water for the electric systems flowing through the second tubes 312 merges in the fourth tank 222 and flows out of the second outlet pipe 242.

Next, an operation of the heat exchanger HE in this embodiment will be described.

In the heat exchanger HE of this embodiment, the engine cooling water flows from the first inlet pipe 141 to the first tank 121 of the upper header tank 10 and then is distributed into the first tubes 311. During flowing in the first tubes 311, the engine cooling water exchanges heat with air flowing around the first tubes 311 to be cooled. The cooled engine cooling water flows through the first tubes 311, merges in the third tank 221 of the lower header tank 20, and then flows out of the first outlet pipe 241.

Similarly, in the heat exchanger HE, the cooling water for the electric systems flows from the second inlet pipe 142 into the second tank 122 of the upper header tank 10, and then is distributed into the second tubes 312. During flowing in the second tubes 312, the cooling water for the electric systems exchanges heat with air flowing around the second tubes 312 to be cooled. The cooled cooling water for the electric systems flows through the second tubes 312, merges in the fourth tank 222 of the lower header tank 20, and then flows out of the second outlet pipe 242.

The heat exchanger HE has the temperature difference between the first tubes 311 in which the engine cooling water flows and the second tubes 312 in which the cooling water for the electric systems flows, and the thermal distortion at a boundary between the first tubes 311 and the second tubes 312 may thereby occur. In this respect, the heat exchanger HE includes the at least one dummy tube 310 between the first tubes 311 and the second tubes 312 of the core 30, so that the heat exchanger HE can limit the thermal distortion at the boundary between the first tubes 311 and the second tubes 312.

However, even if the heat exchanger HE includes the at least one dummy tube 310, the dummy tube 310 may not sufficiently restrict the thermal distortion under conditions in which large temperature difference between the engine cooling water and the cooling water for the electric systems is generated in an extremely low temperature condition. Such condition causes in the thermal distortion at the boundary of the core 30 between the cooling circuit of the engine cooling water and the cooling circuit of the cooling water for the electric systems, i.e., a vicinity of the at least one dummy tube 310.

Figure 2A:
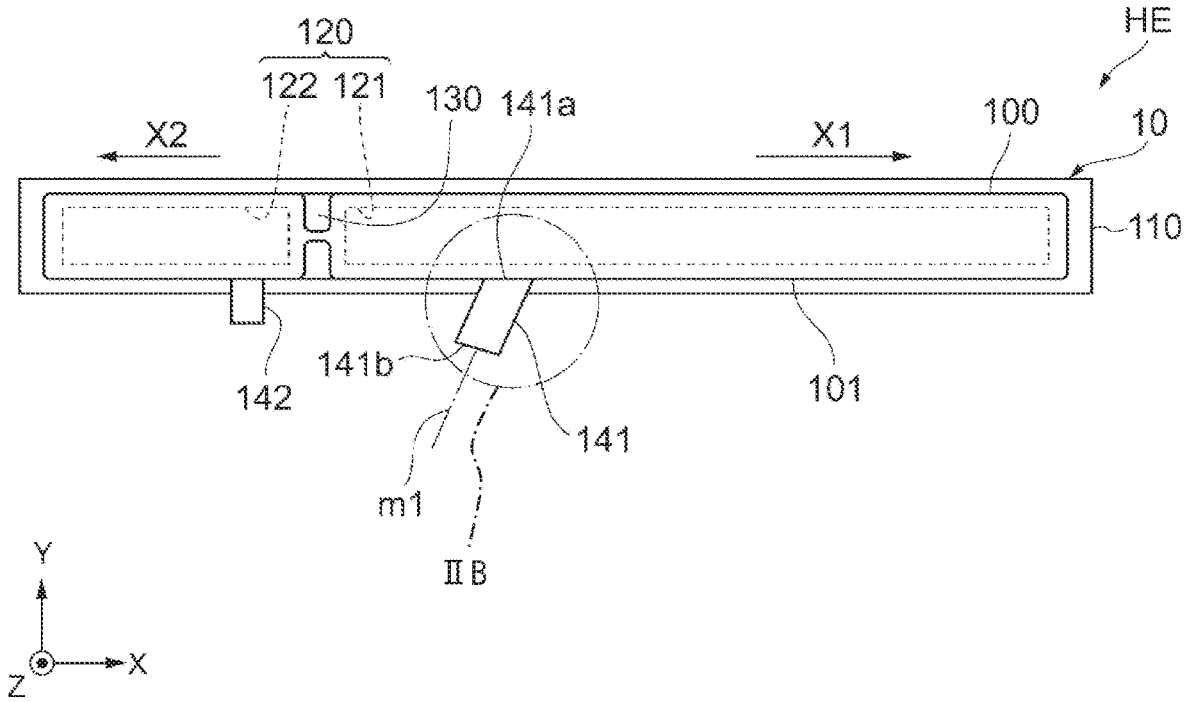
FIG. 2A is a top view of the heat exchanger according to the first embodiment.
Figure 2B:
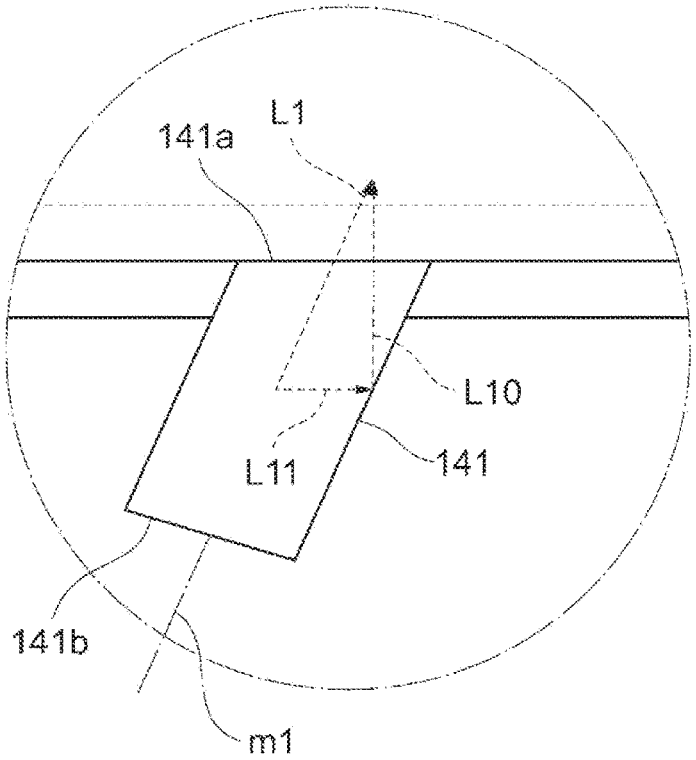
FIG. 2B is an enlarged view of a part IIB in FIG. 2A.

The heat exchanger HE according to this embodiment includes the first inlet pipe 141 configured as shown in FIGS. 2A and 2B. That is, the first inlet pipe 141 has a connection portion connected to the outer surface 101 of the upper header tank 10 to introduce the engine cooling water into the first tank 121. The second inlet pipe 142 has a connection portion connected to the outer surface 101 of the upper header tank 10 to introduce the cooling water for electric motor into the second tank 122. The first inlet pipe 141 is located between the partition 130 and the second end of the first tank 121 positioned opposite to the partition 130. An axial line of the first inlet pipe 141 is inclined from the connection portion to a side of the partition 130 with respect to a direction perpendicular to the outer surface 101 of the upper header tank 10. Thus, when the engine cooling water flows from the first inlet pipe 141 to the first tank 121, the engine cooling water flows in a direction shown by an arrow L1 in FIG. 2B. The flow direction L1 of the cooling water includes not only a component L10 parallel with the airflow direction Y but also a component L11 in the predetermined direction X1. As a result, the cooling water flowing from the first inlet pipe 141 to the first tank 121 is likely to flow in the predetermined direction X1, i.e., a direction away from the partition 130. Thus, the engine cooling water is less likely to flow to the partition 130 in the first tank 121.

The dummy tube 310 is arranged at a part of the core 30 at the same position with the partition 130 in the tube longitudinal direction Z. The engine cooling water is less likely to flow to the partition 130 of the first tank 121, thus the engine cooling water is restricted to flow into the first tubes 311 located close to at least one dummy tube 310.

The amount of engine cooling water flowing in the first tubes 311 near the dummy tube 310 of the core 30 is reduced, thereby reducing temperature gradient, caused by the temperature difference between the engine cooling water and the cooling water for the electric systems, at a vicinity of the dummy tube 310. Thus, the heat exchanger HE can limit the thermal distortion at the core 30 more effectively.

The first inlet pipe 141 is inclined at a predetermined angle excluding a right angle relative to the outer surface 101 of the upper header tank 10 such that the flow direction of the engine cooling water flowing from the first inlet pipe 141 to the first tank 121 includes a direction with a component in the predetermined direction X1. As a result, the thermal distortion at the core 30, which is caused by the temperature difference between the engine cooling water and the cooling water for the electric systems, can be restricted more effectively.

In addition, the above configuration of the first inlet pipe 141 can reduce a flow resistance of the engine cooling water, when the engine cooling water flowing from the first inlet pipe 141 to the first tank 121. The engine cooling water can flow easily to the second end of the first tank 121 away from the partition 130, and the engine cooling water can thereby flow in the first tubes 311 located outer end of the heat exchanger HE. Thus, the deterioration of the radiation property of the heat exchanger HE is also restricted.

The first inlet pipe 141 of the first tank 121 receives the engine cooling water that has higher temperature than the cooling water for the electric systems, and is formed as shown in FIGS. 1 and 2A. Thus, the temperature gradient at the vicinity of the dummy tube 310, caused by the temperature difference between the engine cooling water and the cooling water for the electric systems, is more reduced, which further restricts the thermal distortion at the core 30.

(Modification)

Next, a modification of the heat exchanger HE in the first embodiment will be described.

Figure 3:
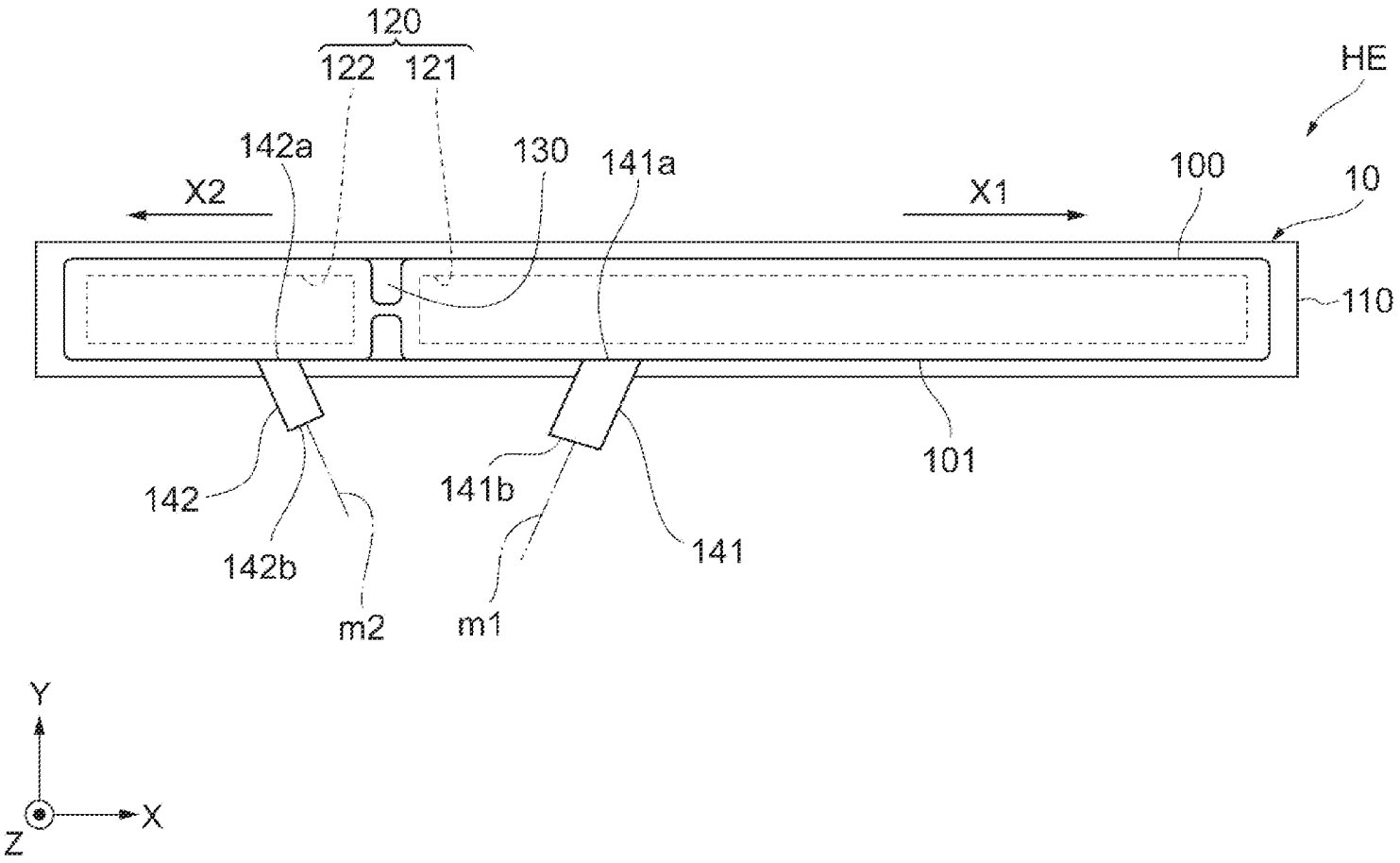
FIG. 3 is a top view of a modification in the first embodiment.

As shown in FIG. 3, a heat exchanger HE in this modification includes the second inlet pipe 142 whose center axis m2 is inclined at a predetermined angle except a right angle relative to the outer surface 101 of the upper header tank 10. That is, the second inlet pipe 142 is located between the partition 130 and the second end of the second tank 122 positioned opposite to the partition 130. An axial line of the second inlet pipe 142 is inclined from the connection portion of the second inlet pipe 142 to a side of the partition 130 with respect to a direction perpendicular to the outer surface 101 of the upper header tank 10. Accordingly, the flow direction of the cooling water for the electric systems flowing from the second inlet pipe 142 to the second tank 122 includes a component in the predetermined direction X2. The second inlet pipe 142 is inclined at a predetermined angle except a right angle relative to the outer surface 101 of the upper header tank 10 such that the flow direction of the cooling water for the electric systems flowing from the second inlet pipe 142 to the second tank 122 includes a direction with a component in the predetermined direction X2. Because of this configuration, the cooling water for the electric systems has difficulty to flow in the second tubes 312 at the vicinity of the dummy tube 310 of the core 30 in the second tank 122. Thus, the temperature gradient at the vicinity of the dummy tube 310 of the core 30 caused by the temperature difference between the engine cooling water and the cooling water for the electric systems is more reduced, which further limits the thermal distortion at the core 30 more effectively.

According to this configuration of the second inlet pipe 142, when the cooling water flows from the second inlet pipe 142 to the second tank 122, the flow resistance of the cooling water for the electric systems can be reduced. Accordingly, the cooling water for the electric systems is likely to flow toward the second end of the second tank 122 away from the partition 130, and the cooling water for the electric systems can thereby flow in the second tubes 312 that are located at an outer side of the heat exchanger HE. This limits the deterioration of the radiation property of the heat exchanger HE.

Second Embodiment

Next, a heat exchanger HE according to a second embodiment will be explained with reference to FIGS. 4 and 5 mainly at different points from the first embodiment.

Figure 4:
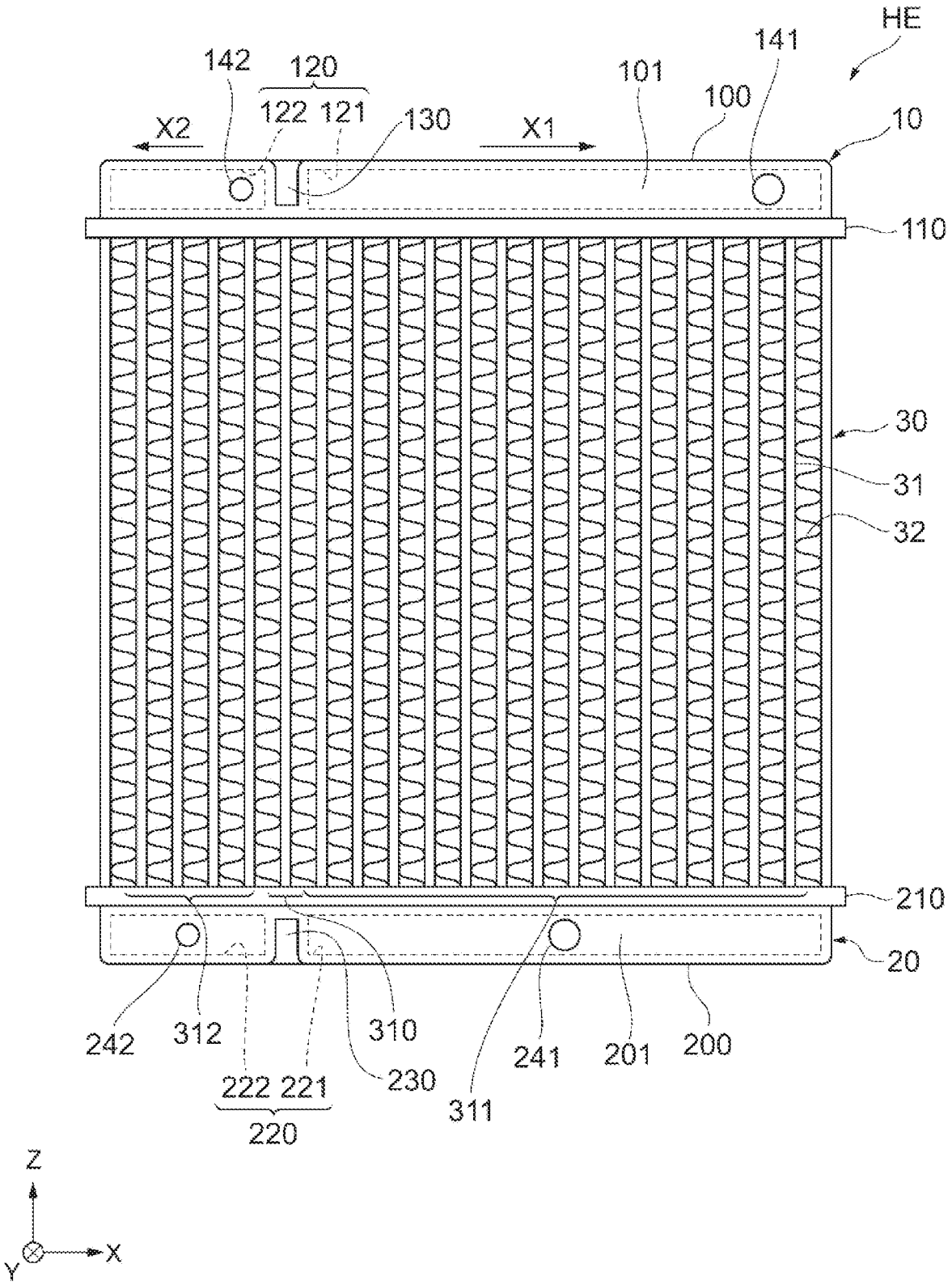
FIG. 4 is a front view of a heat exchanger according to a second embodiment.

As shown in FIG. 4, the heat exchanger HE in this embodiment is different from the first embodiment at the position of the first inlet pipe 141. Specifically, the first inlet pipe 141 is located at a position displaced in the predetermined direction X1 relative to the first outlet pipe 241. As shown in FIG. 5, the first inlet pipe 141 extends substantially parallel in the airflow direction Y toward upstream in the air flow direction Y.

Next, an operation of the heat exchanger HE in this embodiment will be described.

In the heat exchanger HE in this embodiment, the engine cooling water flowing from the first inlet pipe 141 to the first tank 121 is likely to flow toward the first outlet pipe 241. As a result, the engine cooling water is less likely to flow to the partition 130 in the first tank 121, which restricts the engine cooling water to flow in the first tubes 311 located at the vicinity of the dummy tube 310 of the core 30. As a result, the temperature gradient at the vicinity of the dummy tube 310 of the core 30 due to the temperature difference between the engine cooling water and the cooling water for the electric systems is reduced, thereby limiting the thermal distortion at the core 30 more effectively.

The first inlet pipe 141 is shifted in the predetermined direction X1 relative to the first outlet pipe 241. As a result, the thermal distortion at the core 30, due to the temperature difference between the engine cooling water and the cooling water for the electric systems, can be restricted more effectively.

Figure 5:
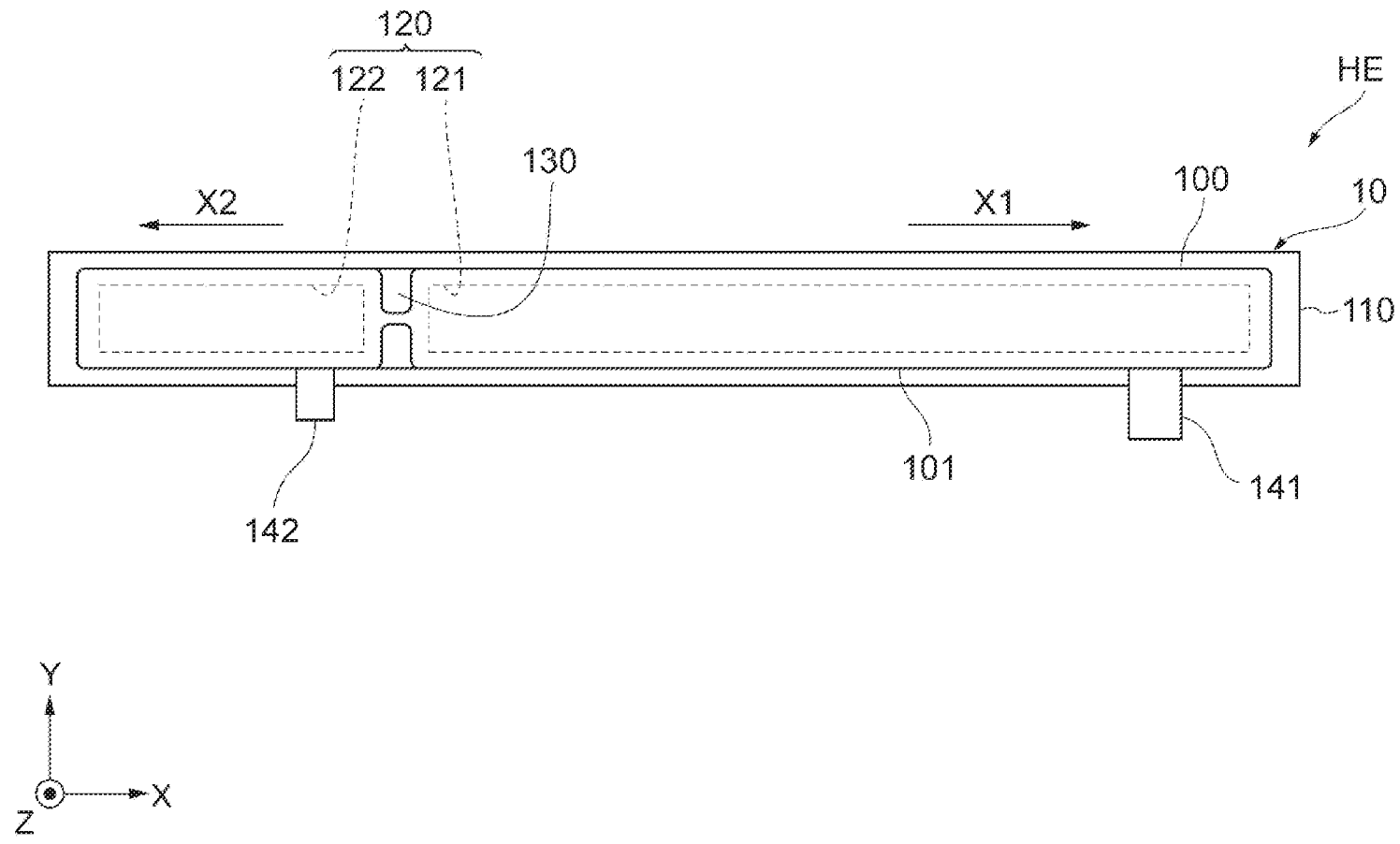
FIG. 5 is a top view of the heat exchanger according to the second embodiment.

The first inlet pipe 141 of the first tank 121 that receives the engine cooling water having higher temperature than the cooling water for the electric systems is formed as shown in FIGS. 4 and 5. This further reduces the temperature gradient at the vicinity of the dummy tube 310 of the core 30 due to the temperature difference between the engine cooling water and the cooling water for the electric systems. Thus, the thermal distortion at the core 30 can be limited more effectively.

(Modification)

Next, a modification of the heat exchanger HE in the second embodiment will be described.

Figure 6:
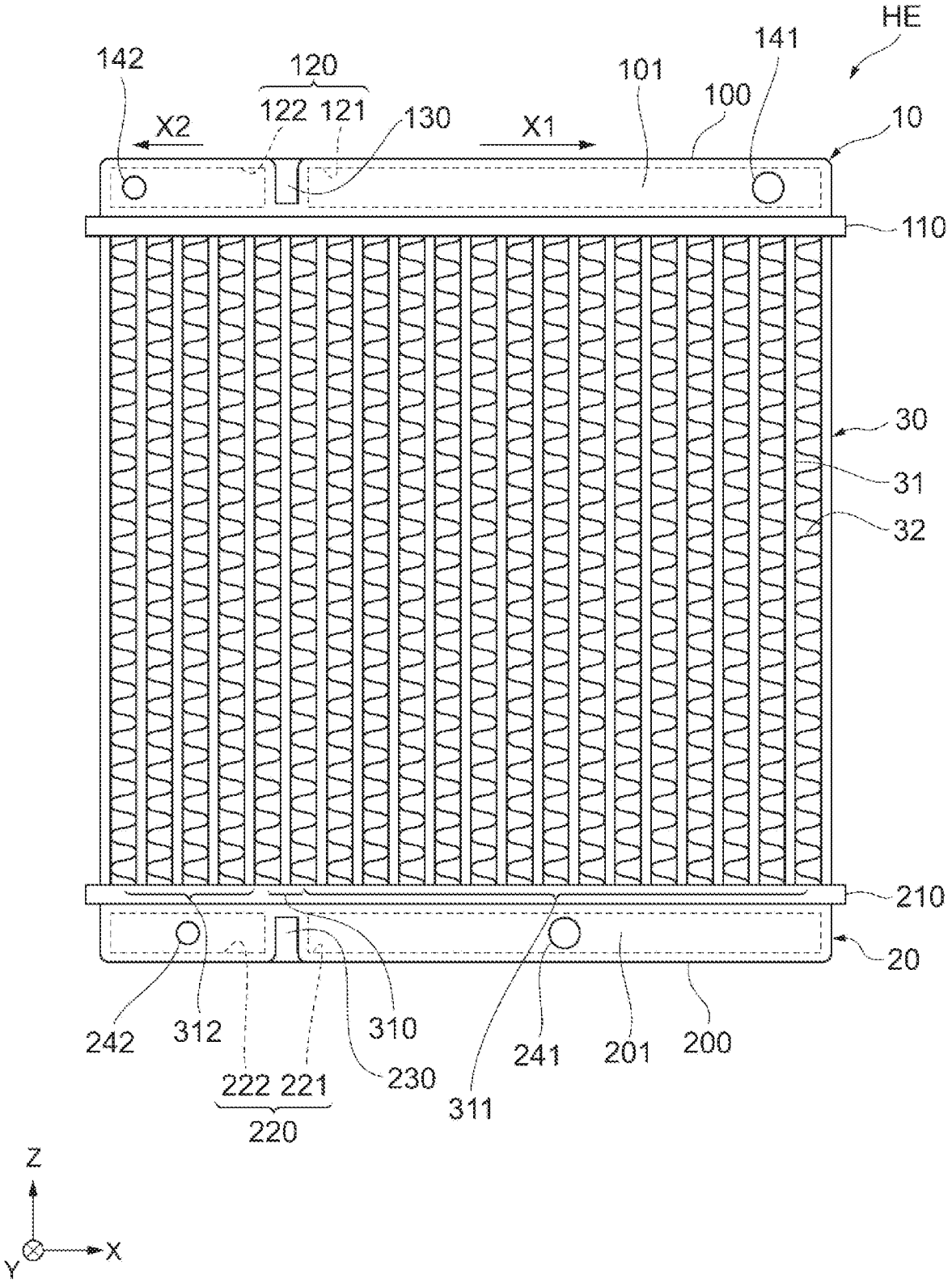
FIG. 6 is a front view of a modification of the heat exchanger in the second embodiment.

As shown in FIG. 6, in the heat exchanger HE of this modification, the second inlet pipe 142 is shifted in the predetermined direction X2 relative to the second outlet pipe 242. Because the arrangement position of the second inlet pipe 142 is shifted to the outer side of the second tank 122 with respect to the center position of the second tank 122 in the predetermined direction X2, the cooling water for the electric systems is less likely to flow in the second tubes 312 at the vicinity of the dummy tube 310 of the core 30. As a result, the temperature gradient at the vicinity of the dummy tube 310 of the core 30 due to the temperature difference between the engine cooling water and the cooling water for the electric systems is more reduced, which further limits the thermal distortion at the core 30.

Other Embodiments

The first inlet pipe 141 and the second inlet pipe 142 may be formed on an outer surface located at a position downstream of the upper header tank 10 in the airflow direction Y other than the outer surface 101 located at a position upstream of the upper header tank 10 in the airflow direction Y.

The first tank 121 of the upper header tank 10 may have a baffle plate therein to restrict the engine cooling water flowing to the partition 130. Similarly, the second tank 122 of the upper header tank 10 may have a baffle plate therein to restrict the cooling water for the electric systems flowing to the partition 130.

The two kinds of the fluid flowing in the heat exchanger HE are not limited to the engine cooling water and the cooling water for the electric systems, the heat exchanger HE may be applied for other appropriate kinds of fluid.

The configuration of the heat exchanger HE in above-mentioned embodiments and modifications can be applied to a heat exchanger without the dummy tube. The present disclosure can be applied to any heat exchangers in which two kinds of cooling fluid having different temperature ranges flow.

The present disclosure is not limited to concrete examples described above. The present disclosure includes alternations and modifications from the embodiments by person in the art as long as including technical features in the present disclosure. Each element, arrangement, condition, shape, and the like of the concrete examples described above are not limited to the embodiments and can be altered appropriately. Each element of the concrete examples can be combined each other appropriately as long as technical contradiction does not occur.

What is claimed is:

1. A heat exchanger comprising:

a core in which a plurality of tubes are stacked;

a first header tank located at an end of the plurality of tubes in a longitudinal direction of the plurality of tubes, the header tank in communication with the plurality of tubes; and a second header tank located at another end of the plurality of tubes in the longitudinal direction, wherein the first header tank includes:

a first partition configured to divide an inside passage of the first header tank into a first tank and a second tank;

a first inlet pipe configured to introduce a first fluid into the first tank; and a second inlet pipe configured to introduce a second fluid having a temperature range different from the first fluid into the second tank, the second header tank includes:

a second partition configured to divide an inside passage of the second header tank into a third tank and a fourth tank, the third tank being in communication with the first tank, the fourth tank being in communication with the second tank;

a first outlet pipe configured to discharge the first fluid from the third tank; and a second outlet pipe configured to discharge the second fluid from the fourth tank, the first inlet pipe is inclined at a predetermined angle except a right angle relative to an outer surface of the first header tank, a flow direction of the first fluid flowing from the first inlet pipe to the first tank includes a component in a predetermined direction that is a direction from a first end of the first tank at which the first partition is provided to a second end of the first tank opposite to the first end, the second inlet pipe is inclined at a predetermined angle except a right angle relative to the outer surface of the first header tank such that a flow direction of the second fluid flowing from the second inlet pipe to the second tank includes a component in a predetermined direction that is a direction from a first end of the second tank at which the first partition is provided to a second end of the second tank opposite to the first end, the first inlet pipe and the second inlet pipe are tilted, and an inlet side end of the first inlet pipe and an inlet side end of the second inlet pipe face each other and an outlet side end of the first inlet pipe and an outlet side end of the second inlet pipe face away from each other.

2. The heat exchanger according to claim 1, wherein a temperature of the first fluid is higher than a temperature of the second fluid.

3. The heat exchanger according to claim 1, wherein
the first fluid is a cooling water for cooling an internal combustion engine of a vehicle, and
the second fluid is a cooling water for cooling an electric system of the vehicle.

4. The heat exchanger according to claim 1, wherein
the first inlet pipe has a connection portion connected to an outer surface of the first header tank,
the second inlet pipe has a connection portion connected to the outer surface of the first header tank,
the first inlet pipe is located between the first partition and an end of the first tank positioned opposite to the first partition, and an axial line of the first inlet pipe is inclined from the connection portion of the first inlet pipe to a side of the first partition with respect to a direction perpendicular to the outer surface of the first header tank.

5. The heat exchanger according to claim 4, wherein
the second inlet pipe is located between the first partition and an end of the second tank positioned opposite to the first partition, and an axial line of the second inlet pipe is inclined from the connection portion of the second inlet pipe to a side of the first partition with respect to the direction perpendicular to the outer surface of the first header tank.

6. The heat exchanger according to claim 1, wherein
the first inlet pipe has a first end directly connected to an outer surface of the first header tank and a second end from which a first fluid is introduced to the first tank through the first inlet pipe,
the first inlet pipe is located between the first partition and an end of the first tank positioned opposite to the first partition, and
the first end of the first inlet pipe is located away from the first partition relative to the second end of the first inlet pipe.

7. The heat exchanger according to claim 6, wherein
the second inlet pipe has a first end directly connected to the outer surface of the first header tank and a second end from which the second fluid is introduced to the second tank through the second inlet pipe, and
the first end of the second inlet pipe is located away from the first partition relative to the second end of the second inlet pipe.

8. The heat exchanger according to claim 1, wherein
the first tank includes a first center in the predetermined direction,
the second tank includes a second center in the predetermined direction,
the first inlet pipe is located on a side of the first center closer to the first partition than to the second end of the first tank, and
the second inlet pipe is located on a side of the second center closer to the first partition than to the second end of the second tank.

9. The heat exchanger according to claim 1, wherein
the first header tank is located upper than the second header tank in a vertical direction.

10. The heat exchanger according to claim 1, wherein
the first inlet pipe has a first end connected to the outer surface of the first header tank and a second end opposite to the first end, the first end being located further from the first partition in the predetermined direction than the second end.

11. The heat exchanger according to claim 1, wherein
the second inlet pipe has a first end connected to the outer surface of the first header tank and a second end opposite to the first end, the first end being located further from the first partition in the predetermined direction than the second end.

* * * * *